United States Patent [19]

Tabata

[11] 4,266,400

[45] May 12, 1981

[54] WRIST WATCH BAND AND MANUFACTURING METHOD THEREFOR

[75] Inventor: Kazutaka Tabata, Tokyo, Japan

[73] Assignee: The Bambi Incorporated, Tokyo, Japan

[21] Appl. No.: 54,855

[22] Filed: Jul. 5, 1979

[51] Int. Cl.[3] ..... B21L 5/02

[52] U.S. Cl. ..... 59/35 R; 59/82; 224/179

[58] Field of Search ..... 63/4; 59/35 R, 80, 82; 228/192; 224/164, 179

[56] References Cited

U.S. PATENT DOCUMENTS

| | | | |
|---|---|---|---|
| 2,829,488 | 4/1958 | Valli | 59/35 |
| 2,976,607 | 3/1961 | Obst | 59/35 X |

*Primary Examiner*—Mark Rosenbaum

*Attorney, Agent, or Firm*—Wills, Green & Mueth Law Corporation

[57] ABSTRACT

A wrist watch band comprises a plurality of metallic band links connected by a continuous flexible connecting member in a non-expansile condition. The links are made of pairs of upper and lower strips fixed to each other on respective opposed surfaces thereof. The watch band can be varied in appearance by changing the shapes of the respective upper strips. A method of manufacturing the watch band comprises a sequence of steps which includes forming a series of respective upper and lower strips, fixing the respective upper and lower strips to each other, inserting a flexible connecting member into a series of aligned openings formed and defined between the upper and lower strips and cutting the links and connecting member into designated band shapes. Thus, the method permits watch bands to be manufactured efficiently and at reduced cost.

8 Claims, 21 Drawing Figures

FIG 14
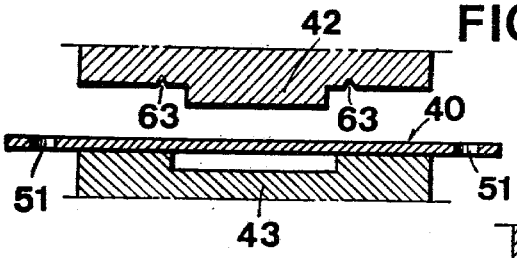
FIG 15
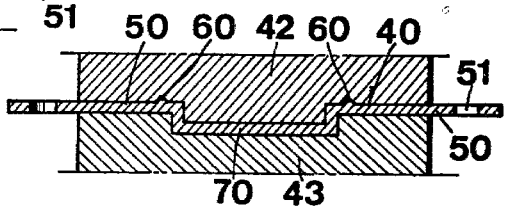
FIG 19
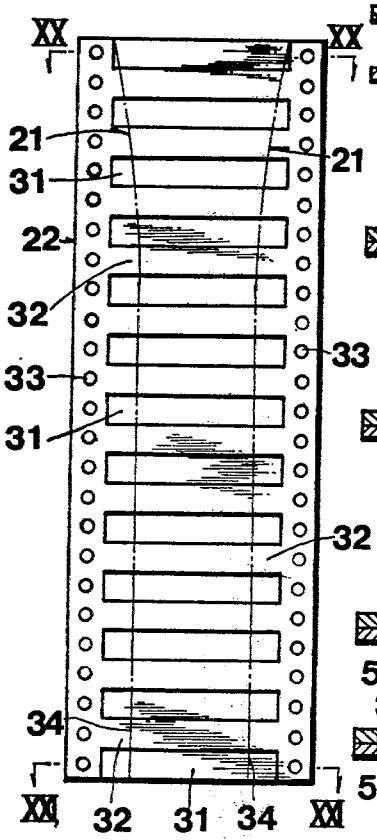
FIG 16
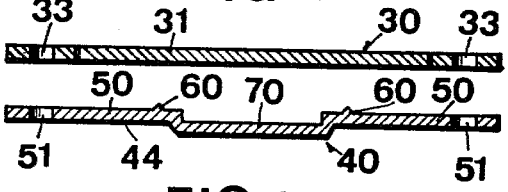
FIG 17
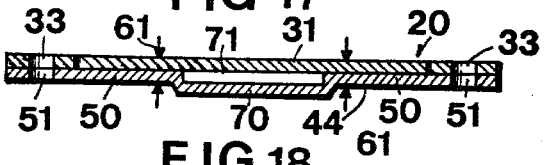
FIG 18
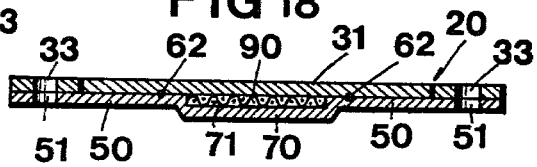
FIG 20
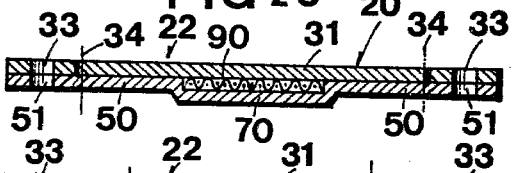
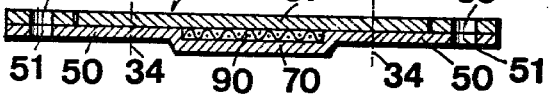
FIG 21

WRIST WATCH BAND AND MANUFACTURING METHOD THEREFOR

BACKGROUND OF THE INVENTION

The present invention relates to a wrist watch band, particularly to a non-expansile metallic watch band made of a plurality of metallic band links which are aligned and connected into a series by a flexible connecting member. The invention further relates to a method for manufacturing the aforementioned wrist watch band.

There have been various known metallic watch bands of different constructions and/or appearances. Non-expansile watch bands have also existed in various constructions and/or appearances. A typical construction and appearance of a watch band is found in Japanese Utility Model Kokoku Koho No. 52-55086. The watch band comprises a plurality of metallic band links, each of which is provided with one or more projective portions on one end thereof, and one or more cut-outs or recesses on the other end, opposing and corresponding to the projective portions of an adjacent link. The respective projective portions and other ends of adjacent links, are provided with apertures which are aligned with each other in an engaged or assembled condition. A pin or axle extends through the aligned apertures to connect the adjacent links to each other.

In the present application, it should be noted that the following terms are given the meanings specified:

"length" means a dimension directed longitudinally of the assembled band;

"width" means a dimension directed laterally of the assembled band;

"end" refers to the longitudinal extent of the assembled band; and

"side" refers to the lateral extent of the assembled band.

A second typical construction and appearance may be found in Japanese Utility Model Kokoku Koho No. 45-14766 and 50-45334, comprising a plurality of metallic band links each of which has a pair of axle members at its ends in parallel to one another. One or more connecting links are laid over the adjacent axle members of adjacent links to pivotally connect the links.

A third typical construction and appearance is shown in Japanese Utility Model Kokoku Koho No. 37-340. The band comprises a plurality of cylindrical links having openings directed and aligned longitudinally of the band. A flexible connecting member runs through the aligned openings in order to connect the individual links into an assembled band.

The conventional wrist watch bands mentioned above are substantially complicated in construction and have troublesome problems of manufacturing and production. In practice, the manufacture of bands of the first type discussed above requires that each of the individual links be provided with at least one projective portion and cut-out on the respective ends thereof. Thereafter, adjacent links are connected with each other by engaging respective projective portions and cut-outs and pivotally linking them with axles. In the process of manufacturing respective individual links and assembling the bands, the following troublesome problems can arise:

(i) it is expected that forming or producing the projective portions and cut-outs on opposite ends of the links to be precisely engageable with one another would be difficult to accomplish, particularly when the links are formed of hard materials, such as stainless steel or the like;

(ii) it is inefficient to individually connect adjacent links with pins or axles, typically with manual labor.

Regarding the aforementioned second type of band, each individual link is formed by scraping a solid metal blank into a shape having recesses or grooves on the upper and lower surfaces thereof to receive connecting links in even axle portions separated from one another on both ends of the links and having an opening for reception of the axle portion to be run through the connecting link, or made of a plurality of separate links laterally connected with one another by a pair of separated pins or axles. Formation of the individual links has required a plurality of steps, resulting in a high cost of manufacturing such watch bands. Further, the connecting links laid over respective adjacent links are substantially C-shaped before connecting the links and are bent into links after laying over between adjacent links. Thus, the two ends of the connecting link appear on the lower surface of the band as a contact line thereof, ruining its appearance, and the bent ends are apt to cause discomfort or injury to the wearer by scratching his wrist. Moreover, the gaps between respective individual links cannot be eliminated in bands of this type.

The aforementioned third type of band can be more efficiently manufactured. Because each link is merely formed by cutting a hollow metal tube to the desired length and is connected with adjacent links by a flexible connecting member, the steps of manufacturing are substantially simplified. However, bands of this type have a serious disadvantage in that the width thereof cannot be easily varied to form gradual tapers widening toward the wrist watch on both sides thereof. At the present time, it is highly desirable to provide such tapered shapes in non-expansile watch bands. Owing to the above-mentioned defect, the band of this type has not been manufactured commercially.

In every conventional wrist watch band, it has been necessary to substantially change the construction if the appearance of the band is to be altered. Therefor, the appearance of the watch bands could not be changed without also instituting new manufacturing lines adapted to the new constructions.

The present invention is to improve generally the aforementioned third type of band, enabling tapers to be provided on both sides of the assembled band and the appearance of the band to be altered without a major change of structure.

SUMMARY OF THE INVENTION

Therefore, it is an object of the invention to provide a non-expansile metallic wrist watch band having a plurality of metallic band links, each of which is connected with respective adjacent ones by a continuous flexible connecting member, the band being capable of embodying tapered shapes which gradually widen toward the wrist watch and of taking on a variety of appearances without varying the basic construction thereof. More specifically, the object of the invention is to provide a watch band having a plurality of links each of which is provided with upper and lower strips secured to one another.

Another object of the invention is to provide a method for efficiently manufacturing the aforementioned wrist watch band. A further object of the invention is to provide a method for manufacturing the watch band which comprises a sequence of steps capable of being performed automatically to reduce cost.

To achieve the above-mentioned and other objects of the invention, a wrist watch band comprises a plurality of band links made of upper and lower strips, and a flexible connecting member disposed between the upper and lower strips. The upper strips have substantially flat surfaces on at least the upper surfaces thereof. The lower strips have portions opposing and facing the lower surface of the upper strips, projections on the upper surface of respective opposing portions, and a stepped-down intermediate portions to receive the connecting member.

Preferably, the upper strips are aligned with one another to have no gaps therebetween and the lower strips are aligned with the lateral center lines of the corresponding upper strips to have substantially narrow gaps between adjacent lower strips, so as to allow downward bending of respective links relative to one another for fitting onto a wearer's wrist. The projections formed on the lower strips act as terminals for spot-welding by means of resistance welding techniques.

The watch band constructed as above can be provided with tapers on both sides thereof, so long as the side edges remain outside of the welded points. Thereby, the shapes of the bands can be easily varied within a range without causing major changes of the structure. Further, the watch band according to the invention can be varied in appearance by changing the shapes of the upper strips. Moreover, the upper strips of the band are aligned to have no gaps between respective links for good appearance.

To achieve the aforementioned and other objects, a method for manufacturing the watch band according to the invention comprises a sequence of steps, including: forming a series of upper members having a series of strips thereon from a flat metal blank; forming a series of lower members having a series of strips thereon from a flat metal blank, the strips having stepped-down central portions and side portions with upwardly directed projections on both sides of the central portions, substantially narrow lateral slits being provided between respective strips of the lower members; facing the upper and lower members such that each of the upper and lower strips are opposed and aligned along their lateral center lines, and fixing the upper and lower members to each other in that orientation to form a series of links; cutting the series of links into respective band lengths; inserting a continuous flexible connecting member into aligned openings defined by the upper member and the central stepped-down portions of the lower member and securing the connecting member onto the two ends of the band lengths; and cutting the sides of the straps into designated band shapes and cutting the connecting members at appropriate locations to separate respective watch bands.

Preferably, the fixing of the upper and lower members to each other is performed by resistance spot-welding with the projections of the lower member.

The upper members are provided with different strips parallel to one another. The strips consist of alternately punched out strips and remaining strips of equal length, respectively. The punched out strips are restored within the opening formed by the punching and kept in a series position, in alignment with the remaining strips of the upper member. The length of the strips may be determined corresponding to the link length. Respective upper and lower members are provided with aligned apertures or holes at regular intervals to function as location means for locating the upper and lower members and as guides for transferring the members through respective steps.

Thus, in accordance with the invention, respective steps for manufacturing the watch band can be combined into a sequence which can be more efficiently performed. The method according to the invention can be carried out by one or a series of machines capable of the operations of the sequence of steps. Further, the method can be used to manufacture watch bands having a changed appearance by merely changing the shapes of the punches forming the upper strips. The watch bands manufactured by the method also have aligned strips on the upper surface thereof with no gaps therebetween for good appearance.

The other objects and advantages of the invention will be understood by the descriptions appearing hereinafter.

BRIEF DESCRIPTION OF THE DRAWINGS

The present invention will be illustrated more fully by way of examples with reference to the accompanying drawings, in which:

FIG. 14 is an enlarged schematic sectional view of a portion of dies forming the lower member which performs one of the processes of the method according to the preferred embodiment of the invention, taken along lateral center line of the die;

FIG. 15 illustrates the dies of FIG. 14 in operative position;

FIG. 16 is a further enlarged sectional view of the individual link in separated position;

FIG. 17 is an enlarged sectional view of the individual link member, the upper and lower strips facing one another;

FIG. 18 is an enlarged sectional view of the link of FIG. 17 wherein the upper and lower strips are secured to each other;

FIG. 19 is a plan view of a strap cut into a designated band length;

FIG. 20 is an enlarged sectional view of the strap taken along line XX—XX of FIG. 19; and FIG. 21 is an enlarged sectional view of the strap taken along line XXI—XXI of FIG. 19.

DESCRIPTION OF THE PREFERRED EMBODIMENT

Figure 1:
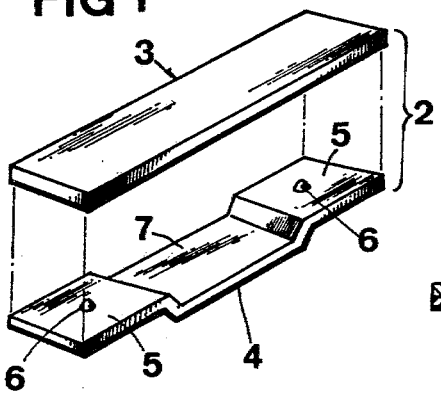
FIG. 1 is an enlarged exploded perspective view of an individual link comprising a wrist watch band constructed in accordance with a preferred embodiment of the invention.
Figure 5:
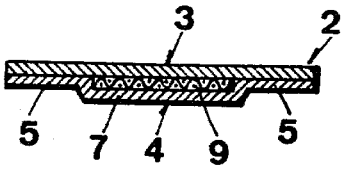
FIG. 5 is an enlarged sectional view of the links taken along line V—V of FIG. 2.

Referring now to the drawings, particularly to FIGS. 1 through 5, there is illustrated a wrist watch band 1 which comprises a plurality of metal links 2 connected by a connecting member 9 in non-expansile position. As apparently shown in FIG. 1, each individual link 2 consists of a pair of upper and lower strips 3, 4. The upper strip 3 is formed of a metal plate having a rectangular shape with flat surfaces on upper and lower sides thereof.

It should be understood that the shape of the upper strip 3 is not limited to the specified rectangular shape, and may be embodied otherwise depending upon the desired design or appearance of the watch band 1. For example, to form a band whose appearance is the same as the aforementioned first type, the upper strip 3 may be provided with one or more projections and cut-outs on both ends thereof which are engageable with each other.

Figure 3:
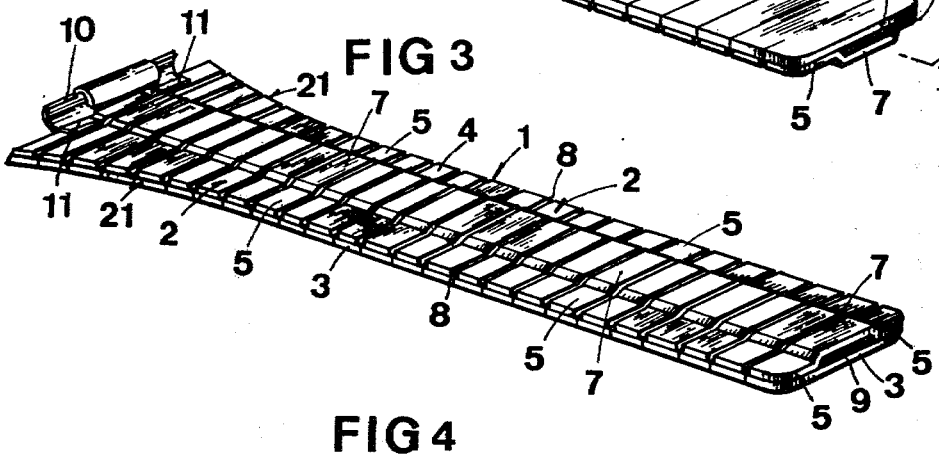
FIG. 3 is a perspective view of the watch band of FIG. 2 in upside down position.
Figure 4:
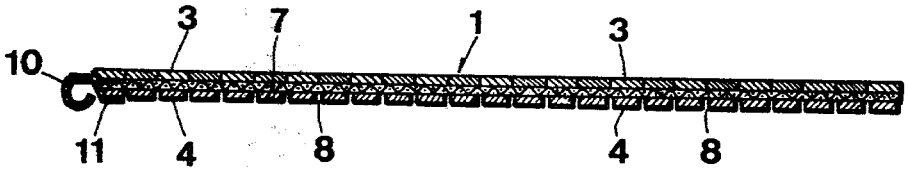
FIG. 4 is a sectional view of the watch band taken along line IV—IV of FIG. 2.

The lower strip 4 has a pair of side portions 5 which are provided with projections 6 on adjacent central portions thereof, and a stepped-down intermediate portion 7. The length of the lower strip 4 is slightly less than that of the upper strip 3 to form substantially narrow gaps 8 between respective adjacent ones, as shown in FIGS. 3 and 4. The gaps 8 function to allow respective links 2 to bend downward relative to one another for fitting the band onto a wearer's wrist. The portions 5 of the lower strip 4 are faced in opposing relationship against the two side portions of the upper strip 3. The opposed surfaces of the upper and lower strips 3 and 4 are fixed to one another on formation of the link 2.

Respective upper strips 3 are aligned in parallel to one another with no gaps therebetween, the lower strips 4 being centered along the lateral center lines of the upper strips 3. Each pair of upper and lower strips 3 and 4 are fixed together at the portions of the projections 6 by spot-welding. The projections 6 function as terminals for resistance welding to connect the upper and lower strips 3 and 4.

A flexible connecting member 9 is inserted through aligned openings respectively defined by the upper strips 3 and the portions 7. The connecting member 9 is fixed at least to the links positioned at both ends of the aligned links 2. Preferably, the connecting member 9 is fixed to each link in order to prevent the links from becoming loose relative to one another. In the preferred construction, the connecting member 9 is fixed to the links 2 by means of spot-welding to adjacent central portions of the respective links.

In practice, the connecting member 9 can be made of a variety of materials; for example, plastics, rubbers or the like. However, in the preferred embodiment, the connecting member 9 is formed of a continuous metal net or meshed wire. The member 9 is the same size or slightly smaller than that of the openings to enable it to be received therein, after the links 2 have been formed by fixing the upper and lower strips 3 and 4 together.

Figure 2:
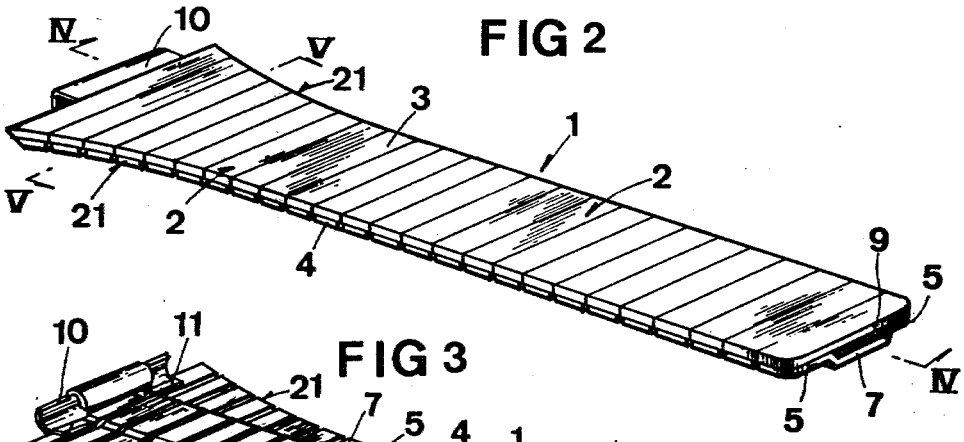
FIG. 2 is a perspective view of the watch band according to the preferred embodiment of the invention.

As shown in FIGS. 2 and 3, the front end of the watch band 1 is provided with an end-piece 10 for securing the band 1 onto a wrist watch. The end-piece 10 has a pair of flat portions 11 which contact and are fixed onto the lower surface of the link 2 at the front end. The method of fixing the portions 11 onto the lower surface of the link 2 is preferably spot-welding at the center of the portions 11.

The watch band 1 thus constructed has a unique appearance, with the upper strips 3 of the respective links 2 being aligned with no gaps therebetween. The band 1 is provided with flexibility by the gaps between respective adjacent lower strips 4 of the links 2, allowing the band to be fitted around the wearer's wrist comfortably.

Further, the width of the respective links of the band 1 constructed as above can be varied to provide tapers on both sides of the links and yield a tapered side edge 21 gradually widening to the front end of the band 1, as shown in FIGS. 2 and 3.

Moreover, the appearance of the upper surface of the bank 1 can be varied by merely changing the shapes of the upper strips without any major structural changes.

Now, referring to FIGS. 6 through 21, there are illustrated elements forming the band 1 during various steps in the manufacturing method of the invention.

Figure 6:
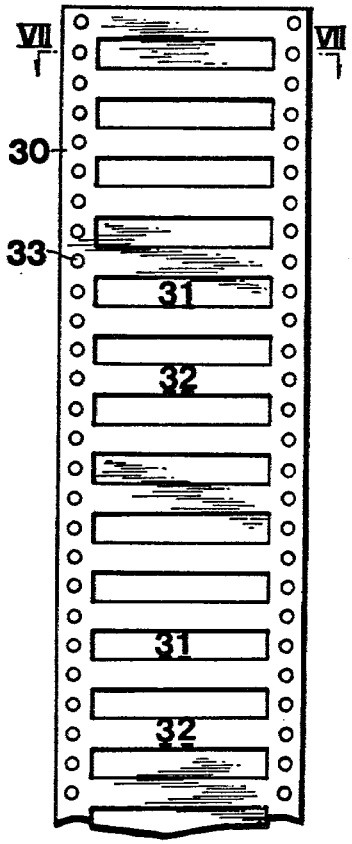
FIG. 6 is a plan view of an upper member formed by the first step of the method in accordance with the preferred embodiment of the invention.
Figure 7:
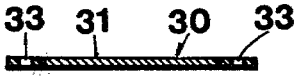
FIG. 7 is a sectional view of the upper member taken along line VII—VII of FIG. 6.

In FIGS. 6 and 7, there is illustrated an upper member 30 to be formed into respective upper sections of link members 20 (FIGS. 17–218.The upper member 30 is formed of a flat metal blank of desired thickness. The material of the metal blank is selected from various metals useful in the formation of watch bands; for example, stainless steel or the like. The thickness of the blank may be approximately half of the desired thickness of the band, and the length of the blank will be chosen to be capable of being separated into a plurality of bands.

As shown in FIGS. 6 and 7, the blank is provided with a series of aligned holes 33 on both sides thereof to be engaged with transfer means (not shown) for transferring or feeding the blank through a series of hereinafter described processes or steps. The holes 33 function as location means to exactly locate the strips 31 and 32 of the upper member 30 over the strips 44 of the lower member hereinafter described.

Figure 12:
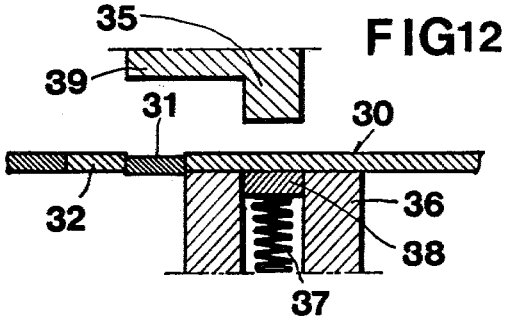
FIG. 12 is an enlarged schematic sectional view of a portion of a punch which performs one of the steps of the method according to the preferred embodiment of the invention, taken along longitudinal center line of the punch.
Figure 13:
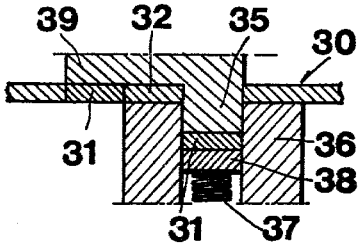
FIG. 13 illustrates the punch of FIG. 12 in operative position.

The upper member 30 has strips 31 punched therefrom and restored into the openings formed by the punching in a series relationship. The strips 31 are respectively positioned on the member 30 with the strips 32 of the member 30 therebetween. The strips 32 represent the portions of the member 30 which are not punched out, and are equal in length to the strips 31. As shown in FIGS. 12 and 13, the strips 31 are alternately punched out of the member 30 by a punch 35. The punching edge of the punch 35 runs into an opening of a punching die 36 having a disk 38 biased by a spring 37 disposed within the opening. The punch 35 has an extended portion 39 with a flat lower surface. The punched out strips 31 of the member 30 are restored by pressure of the spring 37 into the openings formed by the punching operations. The restored strips 31 are tapped by the lower surface of the portion 39 during the next punching operation to further align them within the openings in a series relationship.

The upper member may also be formed in various other manners. For example, forming the upper strips in a series may be accomplished by cutting the blank in lateral directions parallel to one another, with the side portions remaining undisturbed to keep the strips in series. In this manner, a plurality of upper strips are formed on the upper member to comprise the upper sections of the link members.

The shapes of the respective strips are determined by the desired appearance of the finished watch band. The shape of the punch or cutter may be changed to alter the shape of the strips and thus the appearance of the band. The width of the respective strips is equal to or greater than that of the widest portion of the band.

Figure 8:
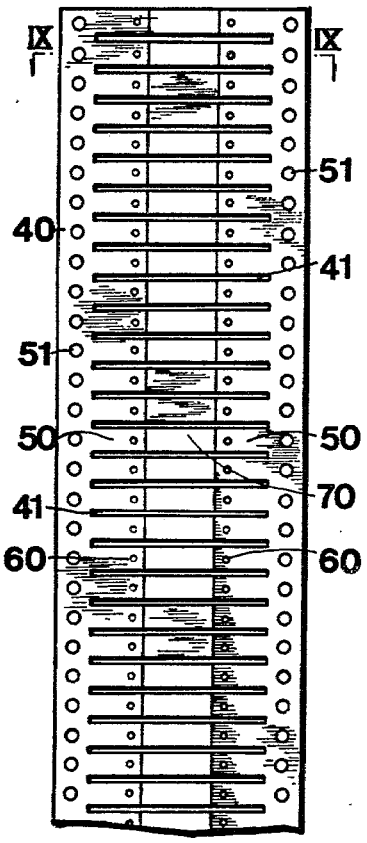
FIG. 8 is a plan view of a lower member formed by the second step of the method according to the preferred embodiment of the invention.
Figure 10:
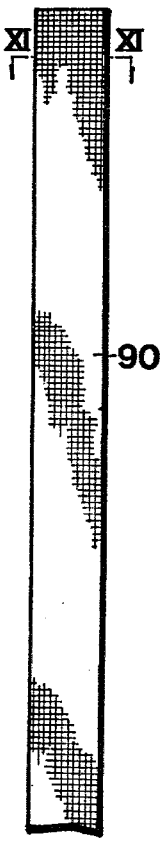
FIG. 10 is a plan view of a flexible connecting member.
Figure 9:
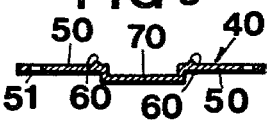
FIG. 9 is a sectional view of the lower member taken along line IX—IX of FIG. 8.
Figure 11:
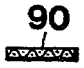
FIG. 11 is a sectional view of the connecting member taken along line XI—XI of FIG. 10.

In FIGS. 8 and 9, there is illustrated a lower member 40 having aligned apertures or holes 51 on both sides thereof. The intervals between the holes 51 are matched with the aforementioned holes of the upper member 30. The lower member 40 is formed of a metal blank, generally being the same material as the upper member 30 and of approximately equal thickness and length. The lower member 40 is provided with a series of spaced slits 41 defining a series of strips 44 corresponding to lower sections of the link members 20 (FIGS. 17–21). Each of the strips 44 has a pair of side portions 50 and a stepped down or recessed intermediate portion 70. On respective central portions of the side portions 50, there are provided small upwardly directed projections 60 acting as welding terminals for fixing the upper and lower members 30 and 40 to each other.

The processes or steps of forming the lower member are shown in FIGS. 14 and 15. The metal blank is transferred into a die station where a pair of dies 42, 43 are provided. The male die 42 is provided with a pair of indentations 63 on both sides of its projective portion, and is pressed onto the blank to form side portions 50 with projections 60 and an intermediate stepped down portion 70.

As shown in FIGS. 16 and 17, the upper member 30 is placed over the lower member 40 in an opposed relationship with the center lines of the upper strips 31 and 32 in alignment with those of the lower strips 44. The aligned holes 33 and 51 function as locating means for positioning the upper and lower members 30 and 40 in exactly opposed relationship. Thereafter, the upper and lower members 30 and 40 are fixed to one another by spot-welding of the projections 60 at the points 61, producing the link members 20. Preferably, the spot-welding may be performed by a resistance welding machine in known manner. By supplying a high electrical potential across the upper and lower members 30 and 40 under pressure, the projections are welded to the upper members.

In this process, a series of band link straps 22 is formed (See FIG. 19). The straps 22 are then separated into designated band lengths. A flexible connecting member 90 is inserted into aligned openings respectively defined by the upper member 30 and the portion 70 of the lower member 40. The openings are represented by the reference number 71 in FIGS. 17 and 18. The connecting member is fixed to the two ends of the straps 22. The length of the member 90 is approximately twenty-fold the predetermined band length. Thus, about twenty straps are connected into a series by the connecting member 90.

The straps 22 are cut at both sides thereof along the cut-lines 34 shown in FIG. 19. At one end of each strap 22, the cut-lines 34 diverge to provide tapers on both sides of the straps. The cut-lines 34 defining the band shape can be moved within a range between the sides of the punched out strips 31 and the welded points 61. Thus, various shapes and widths of bands are obtainable from the same straps. The width of the band can be further varied if the dimension between each side of the punched out portion 31 and the corresponding welded point 61 is increased.

After the band shapes are formed, the straps 22 are linked into an endless loop by the connecting member 90. The linked straps 22 are fitted around a pair of sprockets or rollers to be driven therearound. A polishing machine (not shown) is pressed onto the outer surfaces of the linked straps 22 to polish the upper surfaces thereof.

Thereafter, the series of straps 22 are separated into designated band lengths and are transfered or fed into known finishing processes or steps to complete the watch bands.

The method described herein is useful to efficiently manufacture a wrist watch band. In accordance with the method of the invention, the step of assembling respective individual links into a band is omitted in favor of a process wherein all of the processes can be performed by one or a series of machines. Thereby, manufacture of the watch band can be carried out automatically.

The watch band produced by the above method also has aligned upper strips with no gaps therebetween, such that the upper strips visually appear as a series of metal plates. Further, the band manufactured by the method can be provided in various shapes and appearances with only minor changes in the steps.

Thus, it is apparent that there has been provided a novel and useful wrist watch band and manufacturing method therefor which fulfills all of the objects and advantages sought therefor.

While a specific embodiment of the invention has been shown and described in detail to illustrate the application of the principles of the invention, it will be apparent that the invention may be embodied otherwise without departing from such principles.

I claim:

1. A method of manufacturing a wrist watch band having a plurality of links respectively connected by at least one flexible connecting member, comprising the steps of:

forming from a first metal blank a series of upper members, each of said upper members comprising a plurality of upper strips;

forming from a second metal blank a series of lower members, each of said lower members comprising a plurality of lower strips having stepped-down intermediate portions with side portions on both sides thereof and separated from one another by a series of lateral slits;

placing said upper members over said lower members, respectively, such that each of said upper strips is centered over one of said lower strips to define an opening corresponding to the stepped-down portion of the lower strip, and fixing said upper members to said lower members in that condition to form a series of link members with said openings aligned longitudinally of the series;

cutting the link members to the desired band lengths;

inserting a continuous connecting member through the aligned openings and fixing the link members at both ends of the band lengths to the connecting member;

cutting the side portions of the band lengths into designated band shapes and cutting the continuous connecting member at appropriate locations to separate respective watch bands.

2. A method, as recited in claim 1, which includes the initial step of forming aligned holes in said metal blanks, and holes functioning as guides for feeding the blanks through the remaining steps of said method and as means for locating the upper and lower members to place them in accurate alignment with one another.

3. A method, as recited in claim 1, wherein said upper members are formed by alternately punching out said upper strips and restoring said upper strips into the openings formed by the punching operation for retention in a series relationship.

4. A method, as recited in claim 1, wherein during the steps of forming the upper members at least one side portion of each of the upper strips is left attached to said first metal blank to keep the strips in a series relationship.

5. A method, as recited in claims 1, 2, 3 or 4, wherein the series of lateral slits are formed at predetermined intervals along the length of said second metal blank to define the lengths of the lower strips, the slits substantially comprising narrow gaps between the lower strips.

6. A method, as recited in claims 1, 2, 3 or 4, wherein a plurality of small projections are formed on the lower member, and the step of fixing the upper members to the lower members includes the step of resistance welding the upper members to the lower members using said projections as welding terminals.

7. A method, as recited in claims 1, 2, 3 or 4, including between the steps of cutting the sides of the band lengths and cutting the continuous connecting member, the steps of securing the connecting member around a drive roller to rotate the straps thereabout and polishing the upper surface of the band lengths by pressing a polishing means thereagainst.

8. A method, as recited in claims 1, 2, 3 or 4, wherein the bands formed through the steps are provided with means for connecting the bands to a watch mechanism.

* * * * *